US007862384B2

(12) United States Patent
Myers

(10) Patent No.: US 7,862,384 B2
(45) Date of Patent: Jan. 4, 2011

(54) REPAIR ADAPTER FOR A MODULAR PLUG

(76) Inventor: Kelly H. Myers, 3220 Stonewall Rd., SE, Hampton Cove, AL (US) 35763

( * ) Notice: Subject to any disclaimer, the term of this patent is extended or adjusted under 35 U.S.C. 154(b) by 0 days.

(21) Appl. No.: 12/498,405

(22) Filed: Jul. 7, 2009

(65) Prior Publication Data

US 2010/0003858 A1 Jan. 7, 2010

Related U.S. Application Data

(60) Provisional application No. 61/078,679, filed on Jul. 7, 2008.

(51) Int. Cl.
*H01R 25/00* (2006.01)

(52) U.S. Cl. ..... 439/638; 439/344

(58) Field of Classification Search ..... 439/638, 439/344

See application file for complete search history.

(56) References Cited

U.S. PATENT DOCUMENTS 3,860,316 A 1/1975 Hardesty ..... 339/91 R
5,666,408 A * 9/1997 Lao ..... 379/442
5,697,815 A * 12/1997 Drewnicki ..... 439/638
6,116,958 A * 9/2000 Reichle ..... 439/640
6,340,313 B1 * 1/2002 Hwang ..... 439/638
7,156,683 B2 * 1/2007 Gupta et al. ..... 439/352
7,223,109 B1 5/2007 Cors ..... 439/44
7,361,047 B2 * 4/2008 Strahl ..... 439/354
7,540,756 B1 * 6/2009 Strahl ..... 439/354
7,708,581 B2 * 5/2010 Weiss ..... 439/344

* cited by examiner

*Primary Examiner*—Gary F. Paumen
(74) *Attorney, Agent, or Firm*—James Richards

(57) ABSTRACT

A device and method for repairing a failed modular connector having a broken locking tab by providing an adapter which receives the broken modular connector and includes a mechanism for retaining the broken modular connector, which may include a retaining clip, retaining barbs, or teeth, tight friction, friction bumps, adhesive or other retaining device. The adapter mechanically and electrically connects to the broken connector and provides a straight through wired modular plug with a retaining clip so that the assembly comprising the broken connector and adapter may plug into a jack for the original broken connector and be securely retained.

12 Claims, 5 Drawing Sheets

REPAIR ADAPTER FOR A MODULAR PLUG

RELATED APPLICATIONS

This application claims the benefit under 35 USC 119(e) of U.S. provisional application Ser. No. 61/078,679, titled: "Repair Adapter for Modular Plug," filed 7 Jul. 2008 by Kelly H. Myers. All of the above listed US Patent Documents and Patent Applications are hereby incorporated herein by reference in their entirety.

BACKGROUND

1. Field of the Invention

The present invention pertains generally to the field of interconnection wiring for, inter alia, network communications, more particularly to the repair of modular connectors typically used for, but not limited to network and general telecommunications applications.

2. Background of the Invention

Modular connectors, in particular a series of connectors commonly known as RJ-45, RJ-22, RJ-11 and related connectors are commonly used as computer network connectors and telephone connectors. These connectors are frequently connected and disconnected as equipment is moved or reconfigured. Laptops and other portable equipment are particularly subject to frequent plugging and unplugging of connectors. The modular connectors typically include a locking tab to hold the connector into the socket. The locking tab typically makes a familiar click as the connector is pushed into the socket. The locking tab is, however, fragile and easily broken off of the connector, leaving a connector that otherwise works, but is too easily removed from the socket and may fall out with the weight of the cable, leading to unreliable operation. Since modular connectors require special tools for proper installation on the cable, and because some cables require special pinouts, cables are usually not repaired, but rather replaced, which can be expensive.

Thus, there is a need for a simple way to repair modular connectors having a broken locking tab, potentially saving both time and expense.

BRIEF DESCRIPTION OF THE INVENTION

The present invention pertains to a device and method for repairing a failed modular connector having a broken locking tab by providing an adapter which receives the broken modular connector and includes a mechanism for retaining the broken modular connector, which may include a retaining clip, retaining barbs, or teeth, tight friction, friction bumps, adhesive or other retaining device. The adapter mechanically and electrically connects to the broken connector and provides a straight through wired modular plug with a retaining clip so that the assembly comprising the broken connector and adapter may plug into a jack for the original broken connector and be securely retained.

In one embodiment, the repair adapter comprises a single unitary body forming the modular plug and modified jack. The single unitary body may be formed by a single molding or by assembly of multiple moldings. Alternatively the plug and modified jack may be connected by a short flexible cable.

In another embodiment the retaining barbs may be inwardly directed to a cavity for receiving the broken plug and the barbs may comprise metal.

In another embodiment, the retaining clip may be formed as an extension of a side or bottom of the modified modular jack. The arm may terminate in a catch that engages the back side of the broken plug.

In another embodiment, the broken plug may be retained in conjunction with an adhesive between the inside sides of the jack and the sides of the broken plug.

In some embodiments of the invention the retention of the broken plug may be permanent, i.e., a subsequent attempted separation of the broken plug and repair adapter will likely result in damage to one or both. In alternative embodiments, the broken plug and repair adapter may be subsequently separated without further damage to either.

These and further benefits and features of the present invention are herein described in detail with reference to exemplary embodiments in accordance with the invention.

BRIEF DESCRIPTION OF THE FIGURES

The present invention is described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION OF THE INVENTION

The present invention relates to a repair connector which may be adapted to one or more connectors of various standards relating to "modular" connectors. These connectors include connectors often referred to as RJ11, RJ45, RJ22, 6P6C, 8P8C, 6P4C, 4P4C, or other connectors of these series. Dimension information may be found in various standards, for example, but not limited to TIA-968-A. Further description may be found in U.S. Pat. No. 3,860,316, issued Jan. 14, 1975 to Hardesty, which is incorporated herein by reference in its entirety. Thus, the term modular connector within this disclosure and associated claims refers to these series of connectors. A modular compatible connector is a connector that is electrically and mechanically usable with a modular connector but may or may not be in strict compliance with a particular industry standard.

Figure 1A:
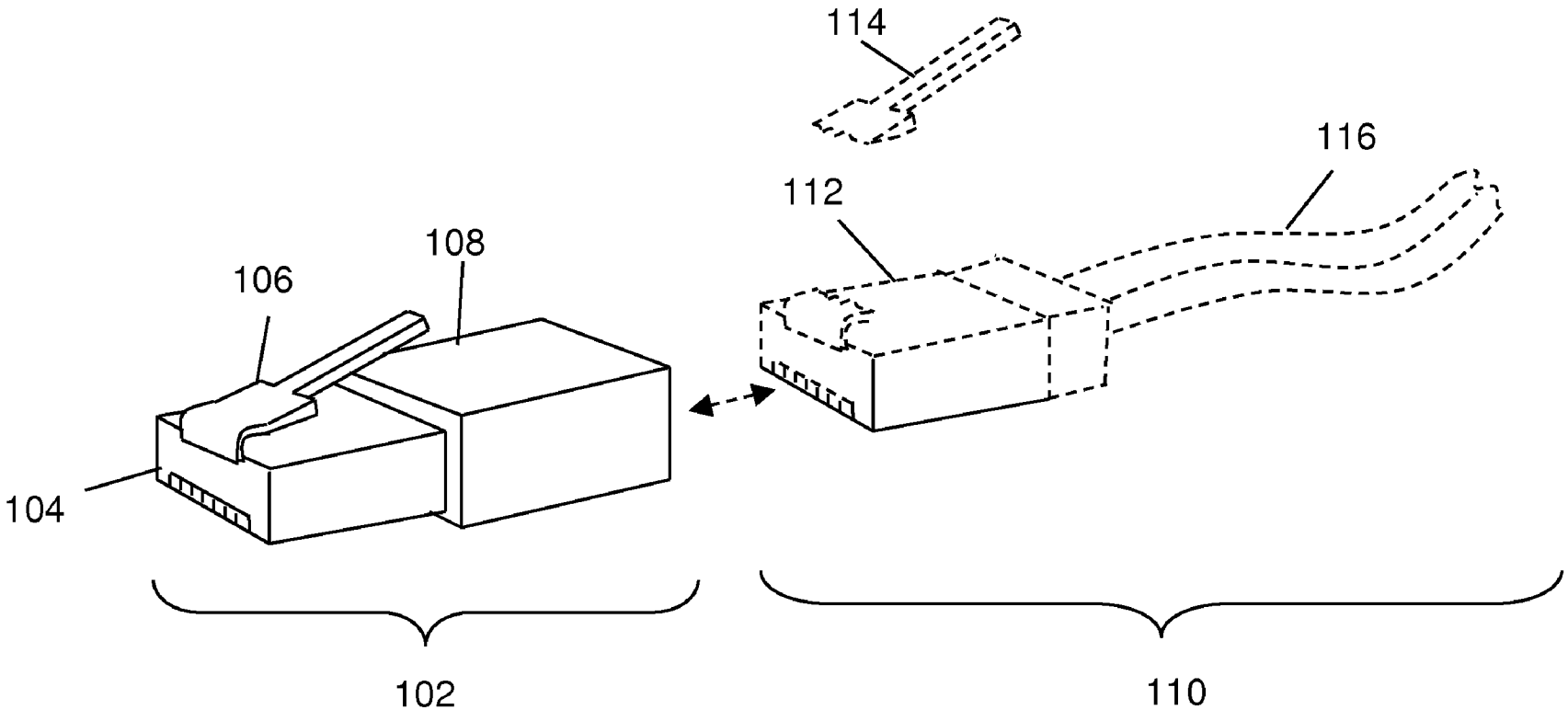
FIG. 1A illustrates an adapter shown with a broken modular connector in accordance with the present invention.

FIG. 1A illustrates an adapter shown with a broken modular connector in accordance with the present invention. Referring to FIG. 1A, the adapter 102 comprises a plug portion 104 (male connector portion), a jack portion 108 (female connector portion) and a locking clip 106. Locking clip 106 may alternatively be referred to as a locking tab, latch, or hook. Also shown is a cable end 110 comprising a broken connector 112, i.e., a connector having a broken and/or separated locking clip 114 and a cable 116. The broken connector 112 would otherwise work except for the ease with which the cable may be pulled out or fall out of an equipment jack (not shown). The adapter 102 includes an alternate locking mechanism (see FIG. 2 and FIG. 3) that is not dependent on the locking clip 114 on the broken connector 112. Thus, the broken connector 112 may be inserted into the adapter 102 and will be held in place securely, even when the locking clip 114 is missing. The adapter 102 includes straight through wiring from the jack portion 108 to the plug portion 104 and may then be plugged into the equipment jack and locked into place using the locking clip 106 on the adapter, thus securing the cable connection.

Figure 1B:
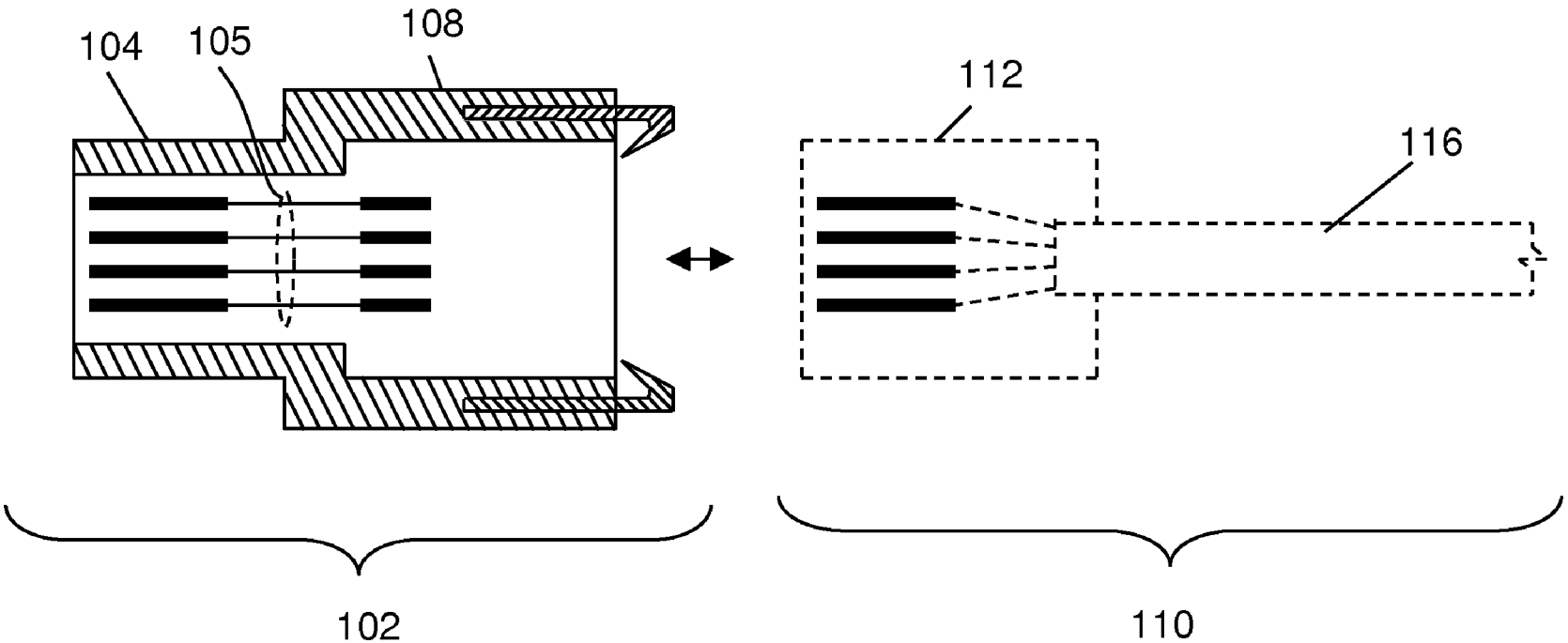
FIG. 1B illustrates an exemplary straight through wiring arrangement for use with the adapter of FIG. 1A.

FIG. 1B illustrates an exemplary straight through wiring arrangement for use with the adapter of FIG. 1A. The straight through wiring 105 connects each pin in the jack 108 to the respective, same number, pin in the plug 104.

Figure 3:
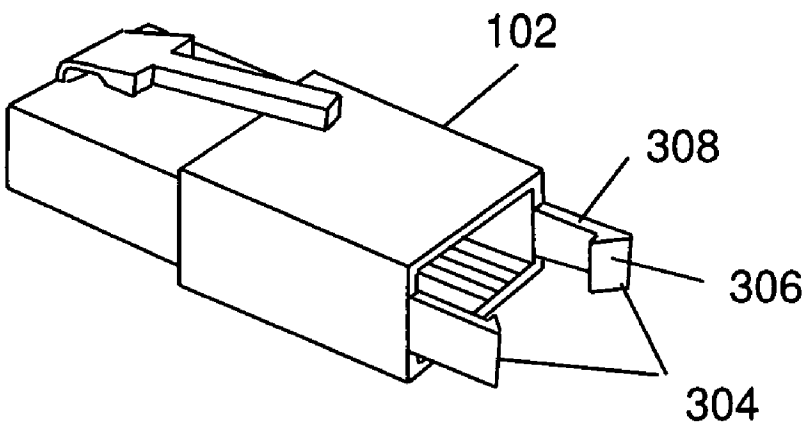
FIG. 3 shows an alternative embodiment using clips to hold the broken connector.
Figure 2:
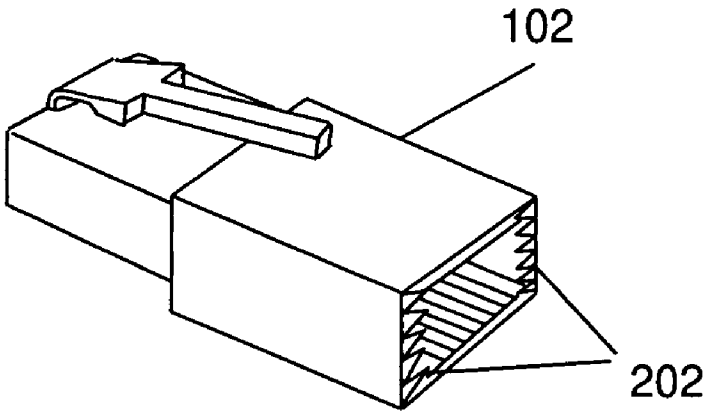
FIG. 2 illustrates one embodiment of the adapter using a friction mechanism to hold the broken connector.

FIG. 2 illustrates one embodiment of the adapter using a friction mechanism to hold the broken connector. FIG. 2 and FIG. 3 show a top perspective view showing greater detail of the jack end 108 of the adapter for receiving the broken plug 112 and illustrating further details of the mechanism for securing the broken plug 112 in place. Referring to FIG. 2, the inside of the jack portion 108 of the adapter 102 includes friction structures 202 to hold the broken connector 112. FIG. 2 shows gripper barbs 202 to increase the friction and hold the broken connector 112 in place. The gripper barbs 202 may be made of plastic, metal, composite (e.g. glass filled plastic), or other suitable material. The gripper barbs 202 may bend as the broken plug is inserted, providing a spring loaded grip to hold the broken plug 112. The backward orientation of the gripper barbs 202 acts to dig into the broken connector and hold tighter as the broken connector 112 is attempted to be pulled out. Alternative friction structures including rough surfaces and/or spring loaded members may be used.

FIG. 3 shows an alternative embodiment using clips 304 to hold the broken connector. Referring to FIG. 3, the adapter 102 includes clips 304 having flexible fingers 308 that wrap around a back corner of the broken plug to hold the broken plug 112 in place. The clips 204 may also have diagonal faces 306 to allow easy insertion of the broken plug 112.

Figure 4:
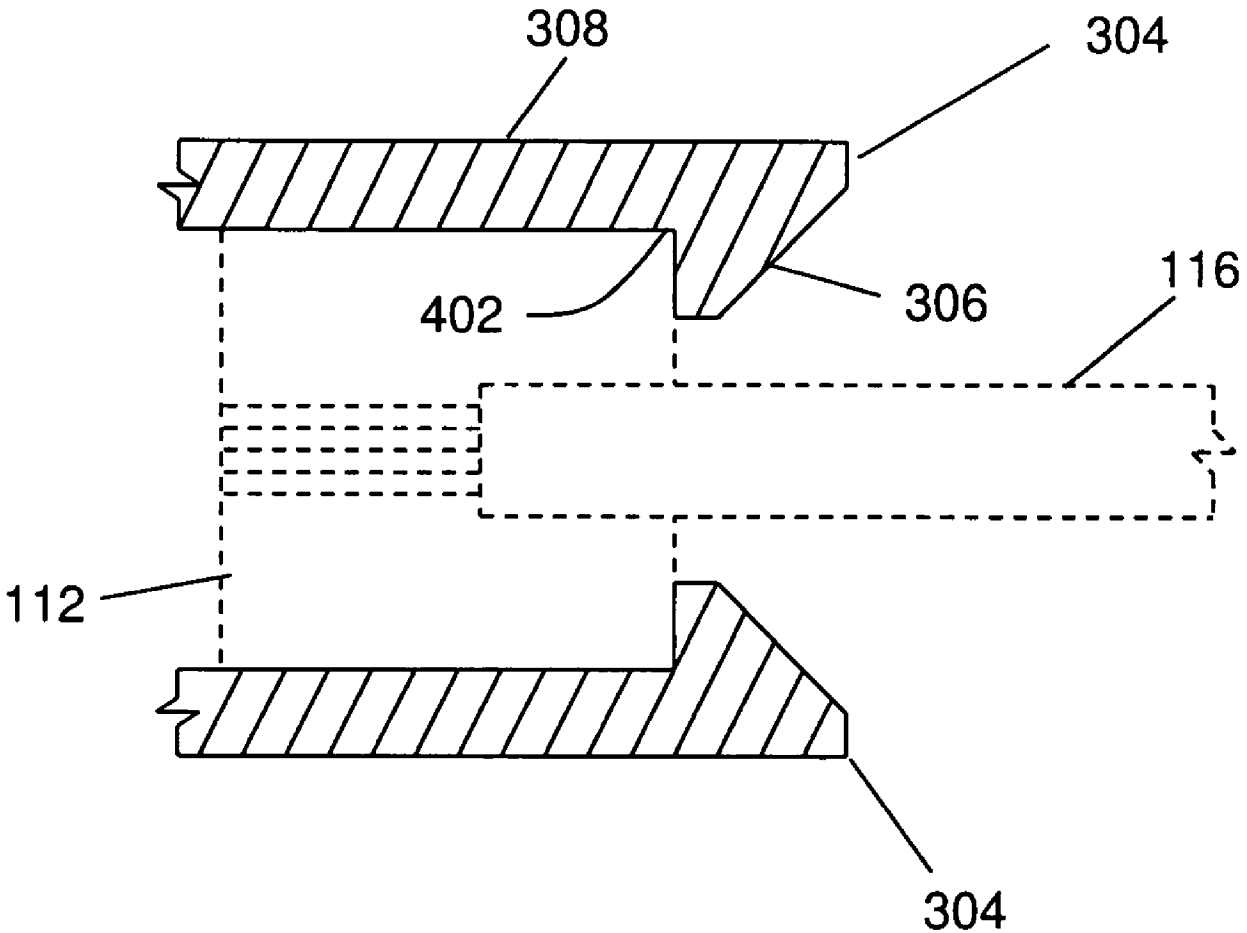
FIG. 4 shows a cross section view of the clip portion of the embodiment of FIG. 3.

FIG. 4 shows a cross section view of the clip portion of the embodiment of FIG. 3. Referring to FIG. 4, the flexible and resilient arms 308 are shown extending from the walls of the jack portion of the repair adapter and running along the side of the broken connector, then wrapping around the back corner 402 of the broken connector 112 to retain the broken connector 112 in the jack of the repair adapter 108. Alternatively, the arms run along the side of the body of the broken plug and end in a catch that engages a back side of the broken plug. The ends of the arms have a sloping or beveled face 306 for ease in insertion of the broken connector. Insertion of the broken connector will open the arms 308 and allow further insertion of the broken connector. When completely inserted, the arms 308 will snap into place and hold the broken connector 112. The resilient arms 308 and catch of the clip 304 form a spring loaded catch 304. The spring loaded catch 304 of FIG. 4 shows the arms and catch being of the same molded plastic of the body 108; however, the arms and/or catch may comprise metal or other materials as desired for forming the arms and catch. The spring loaded clip 304 is shown on the sides Alternatively the spring loaded clip may be positioned on the bottom (opposite the broken locking tab).

Figure 5:
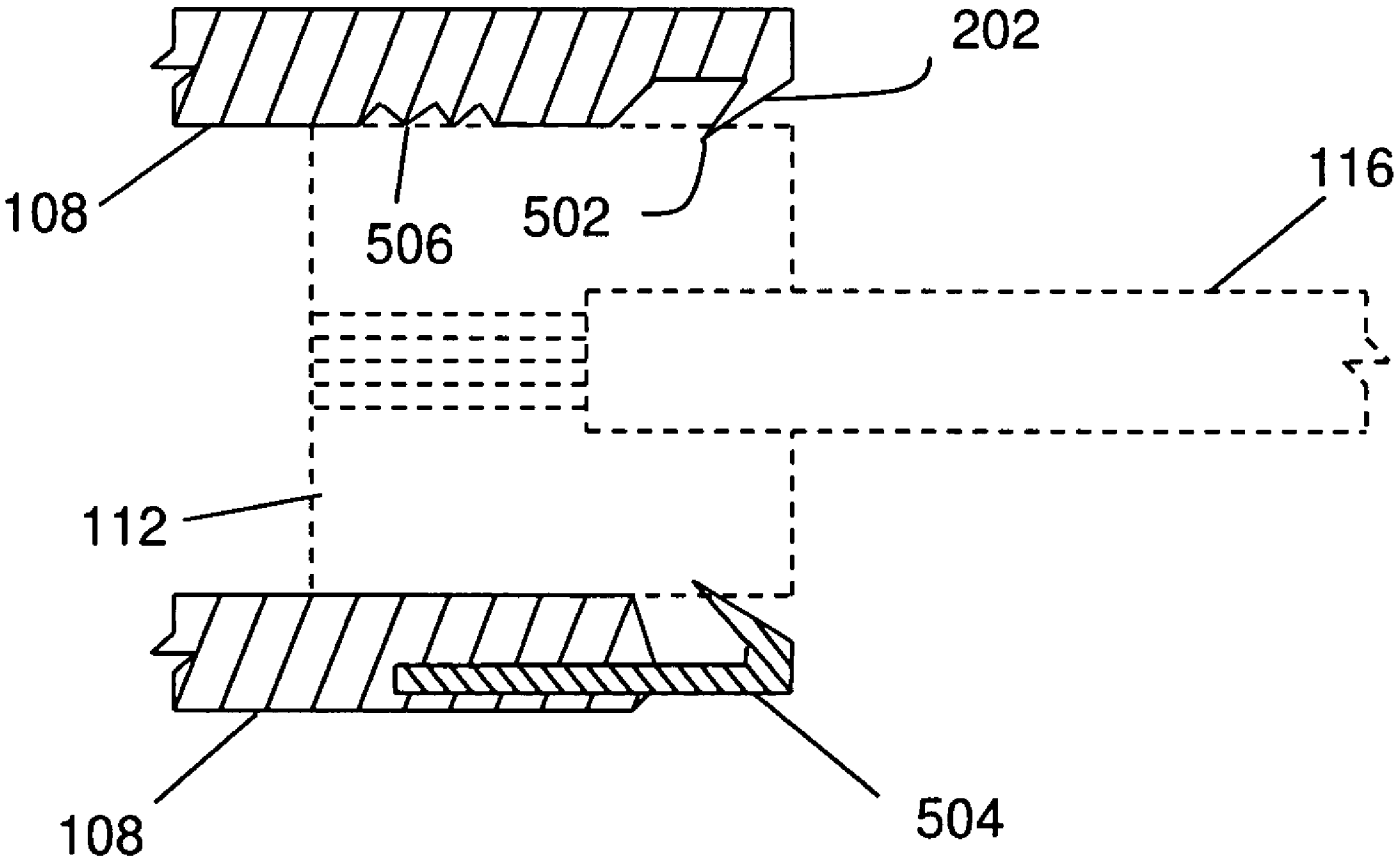
FIG. 5 shows a cross section view of the holding mechanism of FIG. 2.

FIG. 5 shows a cross section view of the holding mechanism of FIG. 2. Referring to FIG. 5, the wall of the cavity of the repair adapter jack 108 that receives the broken connector may include retaining barbs 202. The barbs preferably are inwardly directed, i.e., have a slope toward the interior of the cavity to allow insertion of the broken connector. The barbs 202 are dimensioned for interference fit with the broken connector 112 and preferably to slightly dig 502 into the broken connector to hold the connector 112. The inward slope will further enhance the digging in and holding of the broken connector 112. As shown at the top of FIG. 5, the barb 202 is molded into the wall of the repair adapter 108 and made of substantially the same material. Alternatively, as shown at the bottom of FIG. 5, the barbs 504 may be of a different material, for example metal, and may be molded with the wall of the repair adapter 108 or may be attached by techniques known in the art for attaching metal to plastic.

FIG. 5 also shows a friction bump method of holding the broken connector. The friction bumps 506 may be dimensioned for interference fit with the broken connector 112. Friction bumps 506 or other friction patterns may be used alone or in conjunction with the barbs 202, 504, or clips 304. The friction pattern may be used with or without adhesive.

Other embodiments include adhesive, including pressure sensitive adhesive to hold the broken plug. Adhesive can result in a permanent bond, depending on the adhesive used. The permanent bond can be either an advantage or disadvantage, depending on the application. If the adapter locking clip breaks and the broken connector is not permanently attached, the adapter may be removed and replaced with a new adapter. If the broken connector is permanently attached, another adapter may be connected in series.

In a further embodiment, the plug and jack of the adapter may be configured at other angles than the in-line configuration shown in the diagrams, e.g., at a right angle, or 45 degree angle, or offset, or with a short length of flexible cable between the plug and jack. The short length is preferably less than 10 centimeters and may be less than 1 Meter. In one alternative embodiment, the jack may be supplied without the plug, but with cable attachment capability to be connected by cable to a standard plug or for use in special situations.

In a further alternative, the adapter may include a flexible cover or boot over the locking clip 106 to protect the locking clip 106 from damage while allowing operation of the locking clip 106. The boot may be made of rubber or other flexible material.

In a further embodiment, the adapter may be included with a cable as a kit.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A repair adapter for repairing a broken plug, said broken plug being a first modular compatible plug having a broken locking tab, said repair adapter comprising:

an assembly comprising a second modular compatible plug on a first end, said second modular compatible plug including a locking tab for holding said repair adapter attached and operatively coupled to a mating socket, and said locking tab alternatively allowing said repair adapter to be removed from said mating socket;

said assembly further comprising a holding socket on a second end, said holding socket adapted to receive said broken plug; said holding socket comprising means for holding said broken plug without relying on said broken locking tab;

wherein said second modular compatible plug is electrically connected to said holding socket using a straight through wiring pattern;

wherein said second modular compatible plug and said holding socket comprise a unitary molded body.

2. The repair adapter as recited in claim 1, wherein said second modular compatible plug is compatible with an 8P8C connector or an RJ45 connector.

3. A repair adapter for repairing a broken plug, said broken plug being a first modular compatible plug having a broken locking tab, said repair adapter comprising:

an assembly comprising a second modular compatible plug on a first end, said second modular compatible plug including a locking tab for holding said repair adapter attached and operatively coupled to a mating socket, and said locking tab alternatively allowing said repair adapter to be removed from said mating socket;

said assembly further comprising a holding socket on a second end, said holding socket adapted to receive said broken plug; said holding socket comprising means for holding said broken plug without relying on said broken locking tab;

wherein said second modular compatible plug is electrically connected to said holding socket using a straight through wiring pattern;

wherein said means for holding said broken plug comprises at least one retaining barb.

4. The repair adapter as recited in claim 3, wherein said at least one retaining barb is inwardly directed to a cavity for receiving said broken plug.

5. The repair adapter as recited in claim 3, wherein said at least one retaining barb comprises metal.

6. A repair adapter for repairing a broken plug, said broken plug being a first modular compatible plug having a broken locking tab, said repair adapter comprising:

an assembly comprising a second modular compatible plug on a first end, said second modular compatible plug including a locking tab for holding said repair adapter attached and operatively coupled to a mating socket, and said locking tab alternatively allowing said repair adapter to be removed from said mating socket;

said assembly further comprising a holding socket on a second end, said holding socket adapted to receive said broken plug; said holding socket comprising means for holding said broken plug without relying on said broken locking tab;

wherein said second modular compatible plug is electrically connected to said holding socket using a straight through wiring pattern;

wherein said means for holding said broken plug comprises at least one spring loaded catch engaging a back side of said broken plug.

7. A repair adapter for repairing a broken plug, said broken plug being a first modular compatible plug having a broken locking tab, said repair adapter comprising:

an assembly comprising a second modular compatible plug on a first end, said second modular compatible plug including a locking tab for holding said repair adapter attached and operatively coupled to a mating socket, and said locking tab alternatively allowing said repair adapter to be removed from said mating socket;

said assembly further comprising a holding socket on a second end, said holding socket adapted to receive said broken plug; said holding socket comprising a holder for holding said broken plug without relying on said broken locking tab;

wherein said second modular compatible plug is electrically connected to said holding socket using a straight through wiring pattern;

wherein said holder for holding said broken plug comprises at least one retaining barb.

8. A repair adapter for repairing a broken plug, said broken plug being a first modular compatible plug having a broken locking tab, said repair adapter comprising:

an assembly comprising a second modular compatible plug on a first end, said second modular compatible plug including a locking tab for holding said repair adapter attached and operatively coupled to a mating socket, and said locking tab alternatively allowing said repair adapter to be removed from said mating socket;

said assembly further comprising a holding socket on a second end, said holding socket adapted to receive said broken plug; said holding socket comprising a holder for holding said broken plug without relying on said broken locking tab;

wherein said second modular compatible plug is electrically connected to said holding socket using a straight through wiring pattern;

wherein said holder for holding said broken plug comprises at least one spring loaded catch engaging a back side of said broken plug.

9. A method for repairing a broken plug, said broken plug being a broken modular compatible plug having a broken locking tab, said method comprising:

providing a modified modular compatible jack adapted to receive said broken plug and retain said broken plug mechanically secure to said modified modular jack without relying on said broken locking tab;

attaching and electrically connecting said modified modular compatible jack to a serviceable modular compatible plug to form a repair adapter assembly, said serviceable modular compatible plug having a correctly functioning locking tab;

said repair adapter assembly for securely electrically attaching said broken plug to a device by connecting said broken plug to said repair adapter assembly and connecting said repair adapter assembly to said device;

wherein the step of providing said modified modular compatible jack includes the step of: providing at least one retaining barb within said modified modular compatible jack, said retaining barb dimensioned for an interference fit with said broken plug.

10. The method in accordance with claim 9, wherein said at least one retaining barb comprises metal.

11. A method for repairing a broken plug, said broken plug being a broken modular compatible plug having a broken locking tab, said method comprising:

providing a modified modular compatible jack adapted to receive said broken plug and retain said broken plug mechanically secure to said modified modular jack without relying on said broken locking tab;

attaching and electrically connecting said modified modular compatible jack to a serviceable modular compatible plug to form a repair adapter assembly, said serviceable modular compatible plug having a correctly functioning locking tab;

said repair adapter assembly for securely electrically attaching said broken plug to a device by connecting said broken plug to said repair adapter assembly and connecting said repair adapter assembly to said device;

wherein the step of providing said modified modular compatible jack includes the step of: extending at least one side of said modified modular compatible jack to form a resilient arm ending in a catch for engaging a back side of said broken plug to retain said broken plug connected to said modified modular compatible jack.

12. The method in accordance with claim 11, wherein said resilient arm comprises metal.

* * * * *